United States Patent [19]

Dunning

[11] 4,007,067

[45] Feb. 8, 1977

[54] METHOD FOR MAKING AND USING HOT STAMP TAPE

[75] Inventor: Richard E. Dunning, Hammond, Ind.

[73] Assignee: Avery Products Corporation, San Marino, Calif.

[22] Filed: Mar. 27, 1975

[21] Appl. No.: 562,851

Related U.S. Application Data

[60] Continuation of Ser. No. 233,463, March 10, 1972, abandoned, which is a division of Ser. No. 188,423, Oct. 12, 1971, Pat. No. 3,666,516.

[52] U.S. Cl. ..... 156/61; 156/232; 156/238; 156/239; 156/240; 156/243; 264/219; 427/148; 427/152

[51] Int. Cl.[2] ..... B44C 1/16; B41M 3/12; B44C 1/20

[58] Field of Search ..... 156/238–240, 156/231–232, 61, 235, 243, 245–246, 581; 427/146–149, 152, 162–164, 257–258, 262, 265; 428/914, 152, 151, 194; 264/219; 350/106, 109, 144; 425/385

[56] References Cited

UNITED STATES PATENTS

| | | | |
|---|---|---|---|
| 2,085,048 | 6/1937 | Schultz | 264/259 |
| 2,316,143 | 4/1943 | Peebles et al. | 264/226 X |
| 2,556,078 | 6/1951 | Francis, Jr. | 156/238 |
| 2,654,687 | 10/1953 | Fridolph | 156/239 |
| 2,982,670 | 5/1961 | Jeff | 427/257 X |
| 3,351,510 | 11/1967 | Harris | 156/232 |
| 3,551,177 | 12/1970 | Hechtman et al. | 428/162 |
| 3,684,545 | 8/1972 | Worrall | 428/202 |
| 3,834,925 | 9/1974 | Matsumura et al. | 428/40 |

FOREIGN PATENTS OR APPLICATIONS

| | | | |
|---|---|---|---|
| 702,572 | 1/1954 | United Kingdom | 156/232 |
| 947,636 | 1/1964 | United Kingdom | 427/257 |

*Primary Examiner*—Charles E. Van Horn
*Assistant Examiner*—Thomas Bokan
*Attorney, Agent, or Firm*—Christie, Parker & Hale

[57] ABSTRACT

A web of indeterminate length carrying thermally transferable material, usually referred to as hot stamp tape, is structured to provide an improved simulated wood grain pattern on a substrate after transfer to the substrate of transferable portions of the tape. The web or tape may be provided in sheet form. The structure comprises "ticks" or discrete linearly oriented spots of material having low specular reflectivity coated on a matte carrier sheet, as by printing, and a layer coated thereon to provide the top layer of the transferred material, which replicates the surface of the carrier sheet and the coated ticks or spots.

16 Claims, 4 Drawing Figures

METHOD FOR MAKING AND USING HOT STAMP TAPE

CROSS-REFERENCES

This application is a continuation of application Ser. No. 233,463, filed Mar. 10, 1972, now abandoned which, in turn, is a division of Ser. No. 188,423, filed Oct. 12, 1971, now U.S. Pat. No. 3,666,516.

FIELD

This invention relates to hot stamp tapes and more particularly to webs comprising heat transferable coatings.

PRIOR ART

The instant invention represents an improvement on the disclosures of the following patents:

| U.S. Pat. No. | Patentee | Classification |
|---|---|---|
| 3,467,538 | Best | 117–8 |
| 3,054,715 | White | 156–233 |
| 3,252,847 | Morgan | 156–233 |
| 3,434,862 | Luc | 156–234X |

SUMMARY

Simulated woodgrain patterns have been provided on many surfaces in recent years. Examples include countertops, wall panels, cupboard doors, radio cabinets and the like. Many of these have been provided by printing a woodgrain pattern on paper, laminating the paper to a substrate and covering the paper with a layer of synthetic resinous material. This has been particularly true in the case of countertops and wall panels.

In other instances, a woodgrain pattern has been provided in a transferable layer of a hot stamp tape (or web) and then, by hot stamp transfer, the transferable portion including the woodgrain patterned layer has been transferred to and adhered to a substrate.

More recently, in order to better simulate the grain of wood, it has become common to emboss linearly oriented spaced-apart depressions into the surface during or after transfer, the embossed portions being referred to in the art as "ticks". Alternatively it has been well-known to provide the substrate with such "ticks" by molding or embossment prior to applying a coating thereto and then forcing the coating down into the "ticks".

"Ticks" which have been provided in this manner have aided in providing a realistic simulation of a wood grain but have not been considered to provide optimum simulation.

In accordance with the present invention, it has been found that a highly non-specularly reflective surface portion of a coated surface more nearly simulates to the eye the natural "tick" appearing in actual woodgrain than does a mere depression. The actual "ticks" in actual wood appear to be partially depressed as is the case with embossment. However, they also differ very markedly; that is, to an extremely high degree, in specular reflectivity with respect to the portions of wood immediately adjacent the "ticks". This latter property appears to be far more important in providing optimum simulation of the grain patterns of actual wood than does providing a depression as in the case of either embossment or molding of depressions in the substrate.

Thus, both the discovery involved in recognizing this fact and also the structure and method for providing improved simulated wood grain patterns constitute parts of the instant invention. Prior to the instant invention, it had not been possible to provide simulation of such nonspecular reflectivity characteristics.

Accordingly, I shall describe a preferred embodiment of my invention to provide "ticks" which are substantially or nearly non-specularly reflective; that is, have a specular reflectance below a value of 25% at 60°.

I first provide a carrier sheet or web which may be any carrier sheet or web of the prior art; for example, a polyester film such as "Mylar" (trademark of DuPont), a polyester film such as "Melinex" (trademark of Imperial Chemical Industries), or a web of cellophane or cellulose acetate or paper. I prefer to utilize a polyester film, particularly "Mylar" and I have found that to provide optimum results, I may provide this film as matte surfaced Mylar. A matte-surfaced Mylar may be provided by incorporating an inert particulate substance in the formulation during early stages of manufacture which affects the surface during later biaxial orientation or by embossment or sandblasting or chemical coating.

The carrier may then be coated on one surface with discrete spaced apart portions or "ticks" of a layer of synthetic resinous material in such fashion as to provide on the surface of each "tick", a surface having very low specular reflectance. If desired, a primer coat may first be applied in the pattern of the "ticks" and the "tick" coat applied on top of and in register with the primer coat. Coating may be accomplished by any suitable means such as by silk screening or spraying through a mask or by gravure printing or printing from the surfaces of characters. The composition is one which shrinks during drying to provide a sufficiently crinkled or otherwise irregular and non-glossy surface to provide the desired low degree of specular reflectivity. The discrete spaced apart portions or "ticks" are non-heat-transferably adherently attached to the carrier sheet, so that they will not transfer from the carrier sheet when subjected to the heat and pressure of the transfer operation.

A release coating may then be applied which may be of conventional form and may thus be based on paraffin wax or the like. The normal characteristics of a release coating are that it melts or softens at a temperature below that of other layers in the sheet so that neither the carrier portion which remains behind or the transferred portion (which may be one layer or may be as many as eight or 10 layers) is melted or softened, except that the surface of the layer adjacent the substrate is sufficiently softened or made sufficiently tacky to provide adherence to the substrate.

Extreme thinness of the release coating is absolutely essential if not entirely critical. Thus, the release coating must be relatively thin relative to the size of the bumps in the nearly non-specularly reflective surface of the coated "ticks", to permit subsequent replication of these "bumps".

A layer of replicating synthetic resinous material is then coated relatively thickly over the release coating so that the thickness of each heretofore coated "tick" is either somewhat less or at least not much greater than the thickness of this newly coated layer, the newly coated layer being of synthetic resinous material suited to replicate the surface of the carrier sheet and the surfaces of the heretofore coated ticks. This layer may carry coloring material or may be transparent and may be adapted to be adhered directly to a substrate or may be provided with additional layers which may comprise coloring material and/or tackiness characteristics for providing adherence to a substrate.

For example, it is normal to provide a simulated woodgrain pattern as a plurality of printings of different colors overlying each other and a coating is necessary for each such color. Coatings embodying all these colors may be placed over the replicating coating and the last of such color-containing coatings or an additional coating may be of a composition that provides the desired degree of tackiness during heat transfer to provide adhesion to the substrate.

Although carrier sheets either having a high degree of specular reflectivity, that is, being highly glossy or having a matte surface, that is, having a lower degree of specular reflectivity, have been described, the carrier sheet surface may have any suitable degree of specular reflectivity desired for any particular purpose.

This invention is not limited to providing simulated woodgrain patterns but may be utilized to provide any desired pattern having coated surface portions which vary greatly in specular reflectivity. Thus, on a carrier sheet having high, medium or low specular reflectivity, there may be coated not only one group of "ticks" having a particular set of surface characteristics, but there may also be coated additional groups of "ticks" to provide any desired number of groups, each group having a particular surface characteristic or characteristics which need not be the same as that of any other group coated thereon.

The replicatory coat then replicates all characteristics of all the surfaces presented by all such "ticks" or other coating portions coated thereon, plus the uncoated exposed portions of the carrier sheet.

OBJECTS

It is, therefore, an object to provide a hot stamp tape or web suitable for providing an improved simulated woodgrain pattern on a substrate.

Another object is such a web comprising coating "ticks" having low specular reflectivity and a replicating coating adapted to provide portions having corresponding low specular reflectivity after transfer.

Another object is to provide such a replicatory coat with two different degrees of reduced specular reflectivity.

Further objects will become apparent from the description.

DRAWINGS

In the drawings like reference numerals refer to like parts and:

DESCRIPTION

Figure 1:
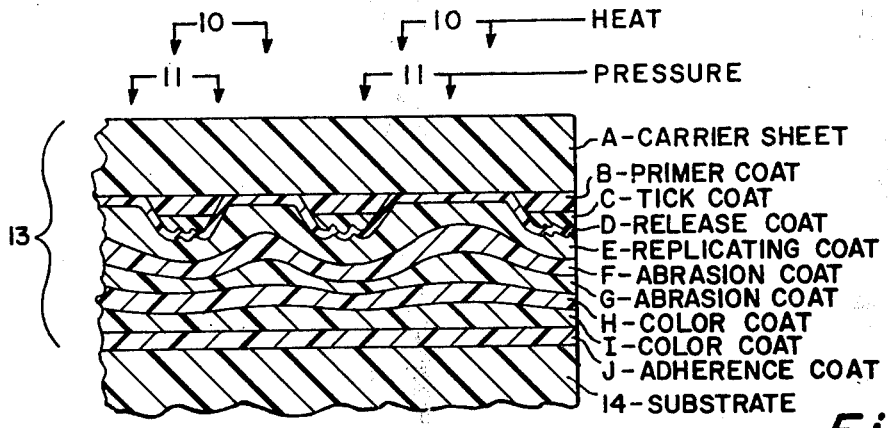
FIG. 1 is a cross-sectional schematic view of one embodiment of the method and article of the invention.

Referring now to FIG. 1, a carrier sheet A may be provided with primer coat portions B which may be provided thereover with tick coat portions C. A release coat D may then be provided and overlying the release coat there may be provided respectively a replicating layer E, an abrasion resistant layer F, a second abrasion resistant layer G, a color coat H, another color coat I, and an adherence promoting coat J.

Figure 2:
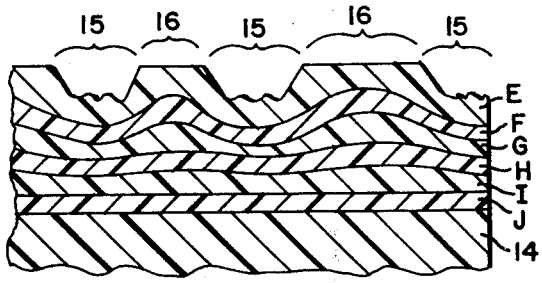
FIG. 2 is a cross-sectional schematic view of the embodiment of FIG. 1 after completion of the process.

Heat as indicated by arrows 10 and pressure as indicated by arrows 11 may be applied to force the laminar assembly 13, consisting of layers A thru J as described, against substrate 14. After thus applying heat and pressure, the carrier sheet and layers B and C and D attached thereto, may be removed to provide the article of FIG. 2, wherein areas of low specular reflectance are indicated at 15 and areas of specular reflectance differing therefrom are indicated at 16.

Figure 3:
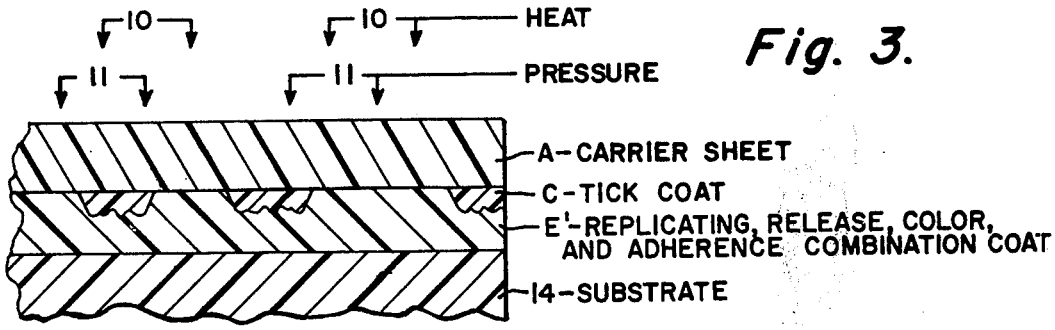
FIG. 3 is a cross-sectional schematic view of another embodiment of the process and article.
Figure 4:
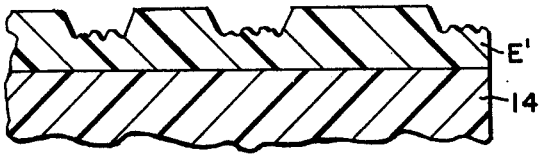
FIG. 4 is a cross-sectional schematic view of the embodiment of FIG. 3 after completion of the process.

In FIG. 3 is shown an embodiment corresponding to that of FIG. 1 wherein many layers are omitted, layer E provides a combination replicating, release, color, and adherence coat. In FIG. 4 is shown the article which remains after completing the process of FIG. 3 and removing sheet A having coating C attached thereto.

Coatings B and C are preferably applied by gravure printing but may be applied by silk screen printing, letter press printing, or the like. All other coats or layers may be applied by any suitable coating means such as by Meyer rod or reverse roller coater.

Below are given specific examples of suitable formulations for each coating layer together with particular characteristics thereof.

The carrier sheet which is preferably in web or tape form may be, as described above, a polyester film such as Mylar or a web of cellophane or cellulose accetate or paper. Mylar having a thickness of from ½ mil to 2 mils is preferred. For a preferred embodiment, it is desired to provide matte Mylar having a specular reflectance at 60° to the horizontal in accordance with ASTM standard D523 of 35% to 60% but in certain embodiments glossy or non matte Mylar which has a specular reflectance determined in like manner of on the order of above 90% and generally on the order of 95% or above may be used.

In Table I are shown the layers present in the various examples. Since the following three layers carrier sheet, "tick" coat, and replicating coat are present in all examples, these are not included in the table so that Table I only relates to nine examples although thirteen examples are presented; in the examples 10, 11, 12, and 13, the only layers present are carrier, tick coat, and replicating coat.

The primer coat as provided serves the purpose of providing for improved adherence between the tick coat and the carrier sheet and it may be omitted if adherence of the tick coat to the carrier sheet is adequate without the presence of the primer coat.

The release coat is generally preferably of a material such as a wax or the like; either natural wax, paraffin wax, or a mixture thereof, or a mixture of wax with other substances, may be used; but it is generally a waxy substance characterized by having a softening range rather than a clear softening point. The softening range or softening point of the release coat is generally preferably lower than the melting or softening points of the carrier sheet and all other layers in the laminar assembly so that when subjected to heat the softness of the release coat when heated permits the replicating coat to be released therefrom.

The replicating coat may in suitable instances be provided with release properties so that when subjected to suitable heat and pressure during hot stamping it is suitably released from the carrier sheet without the presence of a separate and a distinct release coat.

Abrasion resisting coats have the obvious function of providing enhanced abrasion resistance and either or both may be omitted if the replicating layer provides sufficient abrasion resistance in and of itself. Color coats are generally printed on. Generally at least two color coats are necessary if a suitable wood grain or simulated wood grain pattern is to be provided and often three color coats may suitably be utilized for the purpose of providing an attractive and suitable simulated wood grain pattern; however, for providing other patterns which are not simulated wood grain patterns, it may in many instances be suitable to provide only a single color coat or to provide sufficient coloring material in the replicating layer so that no individual color coat is necessary. In some instances, in fact, if no color is desired in the surface finish, no coloring material at all need be incorporated. The purpose of the adherence layer is to promote or improve adherence of the laminar assembly to a substrate, and an adherence coat need be provided only if the adherence is otherwise unsatisfactory.

In Table I, the presence of an "X" in a column indicates that a coating or layer is present in the example heading the column, and the absence of an "X" indicates the absence of a corresponding layer.

TABLE I

| | Example | | | | | | | | |
|---|---|---|---|---|---|---|---|---|---|
| Coat: | 1 | 2 | 3 | 4 | 5 | 6 | 7 | 8 | 9 |
| B primer | X | X | X | X | X | X | | | |
| D release | X | X | X | X | | X | | | X |
| F abrasion | X | | | | | | | | |
| G abrasion | X | | | | | | | | |
| H color | X | X | X | X | X | X | X | X | X |
| I color | X | X | X | X | X | X | X | X | |
| J adherence | X | X | | | | | | | |

Examples 1 to 8 are suitable for providing two-color patterns, if the color coats are printed, which may be simulated wood-grain patterns, simulated leather patterns and the like.

| | Coat B-Primer Coat, parts by weight | | | | | |
|---|---|---|---|---|---|---|
| | Example | | | | | |
| | 1 | 2 | 3 | 4 | 5 | 6 |
| dimethyl formamide | | | 45 | | | 45 |
| Goodyear "Vitel" soluble polyester resin, PE 200 | 10 | | | 5 | | |
| Union Carbide VAGH vinyl resin | | 10 | | | 5 | |
| Union Carbide VMCH vinyl resin | | | 10 | | | 10 |
| dioxane | 45 | 45 | | 62 | | |
| chloroform | 45 | 45 | | 33 | | |
| tetrahydro furan | | | 45 | | 95 | 45 |
| cure temp., ° F. | 250 | 250 | 275 | 250 | 250 | 275 |
| cure time, seconds | 7 | 7 | 7 | 7 | 7 | 7 |
| thickness or wt., wet, lbs. per ream | 4 | 3 | 6 | 8 | 9 | 6 |

Coat C

Tick Coat, parts by weight (dry thickness 5 to 20 microns)

| Ingredient or Condition | Example | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| American Cyanamid "Beetle" urea formaldehyde resin, 212-9 | 20 | | | 10 | | | | | | | | | |
| American Cyanamid "Beetle" urea formaldehyde resin, 220-8 | | | | | | | | | 20 | 12 | | | 12 |
| American Cyanamid Melmac, Melamine resin, 243-3 | | 25 | | | 18 | | | | | | | | |
| HCl | 1 | | | .5 | 1 | | | | .5 | | | | .3 |
| Union Carbide VMCH vinyl resin copolymer of 85% to 88% vinyl chloride, 10.8% to 14.2% vinyl acetate, and 0.8% to 1.2% maleic acid | | | | | | | | | | | 13.5 | 20 | |
| Rohm and Haas AT-50 thermosetting acrylic | | | 30 | | | 12 | | | | | | | |
| Johns Manville Celite diatomaceous earth | 9 | | 11 | | | | | | | 10 | 8 | 10 | |
| Monsanto Santocel FRC, fumed silica | | 2 | | | | 3 | | | 5 | | | | 3 |
| Union Carbide VAGD vinyl resin copolymer of 89.5% to 91.5% vinyl chloride, 2.0% to 5.3% vinyl acetate, and 5.2% to 6.5% vinyl alcohol | | | | | | | | 11 | | | | | |
| Union Carbide VAGH vinyl resin same as VAGD vinyl resin except higher molecular weight | | | | | | | 11 | | | 11 | | | |
| aluminum silicate | | | | 6 | 4 | | | | | | | | |
| p-toluene sulfonic acid | | 2 | | | | | | | | 1 | | | |
| methyl isobutyl ketone | | | | | | | 40 | 35 | | 13 | 45 | 34 | |
| zylol | 70 | | 59 | 28.5 | 27 | 85 | | | | | | | |
| butanol | | 40 | | | | | | | | | | | |
| Dow Corning 704 silicone resin | | | | | | | | | | | 1 | 1 | |
| benzene | | 31 | | 55 | 50 | | 35 | 40 | 74.5 | 53 | 32.5 | 35 | 45 |
| Bakelite 2774 ERL catalyst | | | | | | | 1 | 1 | | | | | |
| polyurethane, prepolymer | | | | | | | 13 | 13 | | | | | |
| cure time | 1 | 1 | 30 | 2 | 2 | 1.5 | 24 | 24 | 1 | 45 | 20 | 20 | 50 |

Coat C-continued

Tick Coat, parts by weight (dry thickness 5 to 20 microns)

| Ingredient or Condition | Example 1 | 2 | 3 | 4 | 5 | 6 | 7 | 8 | 9 | 10 | 11 | 12 | 13 |
|---|---|---|---|---|---|---|---|---|---|---|---|---|---|
| cure temp., ° F. | min. 350 | min. 350 | min. 250 | min. 300 | min. 300 | min. 325 | hrs. 120 | hrs. 120 | min. 250 | sec. 245 | sec. 275 | sec. 275 | sec. 240 |

Coat D

Release Coat, parts by weight, 1 to 4 pounds per ream, wet

| | Example 1 | 2 | 3 | 4 |
|---|---|---|---|---|
| petroleum wax, $C_{43}H_{88}$ | 5 | | .5 | |
| petroleum wax, $C_{41}H_{84}$ | | 4 | | |
| montan wax | | | 7 | 5 |
| ethyl hydroxyethyl cellulose | | | | 4 |
| benzene | 95 | 96 | | 50 48 |
| $CCl_4$ | | | 93 | 45 |
| methyl ethyl ketone | | | | 48 |
| trichloroethylene | | | 99.5 | |

Coat F-continued

Abrasion Coat

| | Example 1, parts by weight |
|---|---|
| of 9.5% to 11.5% vinyl acetate and balance vinyl chloride | |
| acetone | 50 |
| benzene | 29 |
| cure: 5 seconds at 260° F. | |
| coating weight, wet: 15 lbs./ream | |

Coat E

Replicating Coat, parts by weight

| | Example 1 | 2 | 3 | 4 | 5 | 6 | 7 | 8 | 9 | 10 | 11* | 12** | 13* |
|---|---|---|---|---|---|---|---|---|---|---|---|---|---|
| Union Carbide VYHH vinyl resin copolymer of about 13% vinyl acetate and about 87% vinyl chloride, medium molecular weight | 17 | 12 | | | | | 4 | | 15 | 4 | | | |
| Nitrocellulose, ½ sec. R.S. | | | 18 | 13 | | | | 5 | | | 3 | | |
| Methyl methacrylate, medium molecular wt. | | | | | 20 | 15 | 14 | 12 | | 13 | 14 | 20 | 10 |
| $TiO_2$ | | | | | | | | | | | 17 | | |
| Iron oxide red | | | | | | | | | | 15 | | | 10 |
| butanol | | | 55 | | | | | 28 | | | | | |
| benzene | 50 | 88 | | 29 | 80 | | 41 | | 35 | 34 | | 80 | 80 |
| acetone | 33 | | 27 | 58 | | 85 | 41 | 55 | | 34 | 66 | | |
| cure time, seconds | 40 | 40 | 30 | 30 | 27 | 25 | 30 | 10 | 10 | 5 | 7 | 10 | 10 |
| cure temp., ° F. | 180 | 180 | 200 | 200 | 205 | 200 | 200 | 225 | 230 | 240 | 220 | 215 | 215 |
| coating weights, wet pounds/ream | 30 | 40 | 30 | 45 | 10 | 12 | 15 | 30 | 20 | 20 | 20 | 40 | 4 |

*single uniform color
**clear

Coat F

Abrasion Coat

| | Example 1, parts by weight |
|---|---|
| Polyethylene, micronized | 7 |
| Union Carbide vinyl resin VYNS medium-high molecular weight copolymer | 14 |

Coat G

Abrasion Coat

| | Example 1, parts by weight |
|---|---|
| Methyl methacrylate | 10 |
| aluminum oxide | 8 |
| acetone | 78 |
| cure: 30 seconds at 200° F. | |
| coating weight, wet: 45 lbs./ream | |

Coat H

First Color Coat, parts by weight (cure at 180° F. to 220° F. for 4 to 20 seconds)

| | Example 1 | 2 | 3 | 4 | 5 | 6 | 7 | 8 | 9** |
|---|---|---|---|---|---|---|---|---|---|
| Methyl methacrylate | 10 | | | 20 | | | 15 | | |
| Vinyl Chloride resin | | 10 | | | | | | 12 | |
| Nitrocellulose, ½ sec RS | | | | | 9 | 12 | | | |
| Me methacrylate - Bu methacrylate copolymer | | | 21 | | | | | | 16 |
| $TiO_2$ | | | 1.2 | | | | 3 | | 16 |
| Molybdate orange | .5 | 1 | | | | | | | 4 |
| carbon black | 1 | .5 | 1.2 | 2 | .5 | .7 | 1 | 1 | 1 |
| acetone | | 88.5 | 48.6 | 78 | 30.5 | 29.3 | 81 | 37 | 21 |
| benzene | 88.5 | | | | | | | | 21 |
| methanol | | | 28 | | 60 | 58 | | | 21 |
| coating weights, wet, | | | | | | | | | |

Coat H-continued

First Color Coat, parts by weight (cure at 180° F. to 220° F. for 4 to 20 seconds)

| | Example | | | | | | | | |
|---|---|---|---|---|---|---|---|---|---|
| | 1 | 2 | 3 | 4 | 5 | 6 | 7 | 8 | 9** |
| lbs./ream | * | * | * | * | * | * | * | * | 40 |

*depends on pattern
**single color

Coat I

Second Color Coat, parts by weight (coating weights depend on pattern, cure at 180° F. to 220° F. for 4 to 20 seconds)

| | Example | | | | | | | |
|---|---|---|---|---|---|---|---|---|
| | 1 | 2 | 3 | 4 | 5 | 6 | 7 | 8 |
| Vinyl chloride resin | 10 | 20 | | | 8 | 22 | | |
| Me methacrylate-butyl methacrylate copolymer | | | 10 | 20 | | | 8 | 22 |
| Iron oxide red | | | | | | | | |
| Molybdate orange | 5 | 10 | 4 | 9 | 4 | 4 | 4 | 4 |
| Chrome yellow | 5 | 10 | 2 | 1 | 3 | 12 | 3 | 12 |
| $TiO_2$ | 1 | | 1 | 2 | 1 | 3 | 1 | 3 |
| carbon black | | | 1 | 2 | 1 | 1 | 1 | 1 |
| acetone | 79 | 60 | | 44 | 83 | 58 | | |
| benzene | | | 82 | | | | 83 | 58 |
| methanol | | | | 22 | | | | |

Coat J

Adherence Coat, parts by weight

| | Example | |
|---|---|---|
| | 1 | 2 |
| Methyl methacrylate - butyl methacrylate copolymer | 20 | |
| Nitrocellulose, ½ sec R.S. | | 15 |
| Tricresyl phosphate | 5 | 6 |
| octyl alcohol | 40 | 40 |
| pentane | 25 | 29 |
| acetone | 10 | 10 |
| cure time, minutes | 2 | 2 |
| cure temp., ° F. | 120 | 120 |
| coating weight, wet, lbs./ream | 15 | 50 |

Further embodiments and variations will be apparent to those skilled in the art and are intended to be included within the scope of the invention.

Having thus described by invention, I claim:

1. In a method for forming on a substrate a finish having a surface in which discrete spaced apart portions vary in specular reflectance from the remaining portions of the surface, the steps of:

providing a heat-resistant, flexible, foldable carrier sheet having a surface having a predetermined specular reflectance;

coating onto said carrier sheet surface a plurality of discrete spaced apart portions of a synthetic resinous material, said spaced apart portions being coated onto the carrier in a fluid condition and shrunk during drying to form irregularly-shaped surfaces remote from the surface of the carrier sheet and having a lower specular reflectance than that of the uncoated portion of the carrier sheet surface, said spaced apart portions being so adherently attached to the carrier sheet that they will not transfer from the carrier when heat and pressure are applied thereto;

coating over the surface of the carrier sheet and said spaced apart portions a transferable replicating layer comprising a coating of sufficient thickness of a synthetic resinous material to replicate both the specular reflectance of the uncoated portion of the carrier sheet surface and the specular reflectance of the remote surfaces of said spaced apart portions without said spaced apart portions transferring from the carrier sheet;

providing an adherence coat for adhering the transferable replicating layer to a substrate;

pressing the carrier sheet and the replicating layer against the substrate and applying heat to adhere the replicating layer to the substrate; and releasing the carrier sheet and said adherently attached spaced apart portions from the surface of the replicating layer to provide the replicating layer as a surface finish attached to the substrate and having a plurality of discrete spaced apart portions having a lower specular reflectance than the remaining portion of the surface finish.

2. The method according to claim 1 including providing a simulated wood grain finish by coating at least two printed pigmented layers over the replicating layer when said replicating layer is in contact with the carrier sheet, the replicating layer being a clear coat so that the pigmented layers are visible through it.

3. The method according to claim 1 including forming said spaced apart portions from a thermosetting synthetic resinous material.

4. The method according to claim 1 including forming said spaced apart portions from a synthetic resinous material having a fine particulate filler.

5. The method according to claim 4 including coating said spaced apart portions so they have a dry thickness in the range of about 5 to about 20 microns.

6. In a method for forming on a substrate a finish having a surface in which discrete spaced apart portions vary in specular reflectance from the remaining portions of the surface, the steps of:

providing a heat-resistant, flexible, foldable carrier sheet having a surface having a predetermined specular reflectance;

coating onto said carrier sheet surface a plurality of discrete spaced apart portions of a synthetic resinous material having a fine particulate filler, said spaced apart portions being coated directly onto the carrier in a fluid condition and shrunk during drying to form irregularly-shaped surfaces remote from the surface of the carrier sheet and having a lower specular reflectance than that of the uncoated portion of the carrier sheet surface, said spaced apart portions being so adherently attached to the carrier sheet that they will not transfer from the carrier when heat and pressure are applied thereto;

coating over the surface of the carrier sheet and said spaced apart portions a transferable replicating layer comprising a coating of sufficient thickness of a synthetic resinous material to replicate both the specular reflectance of the uncoated portion of the carrier sheet surface and the specular reflectance of the remote surfaces of said spaced apart portions without said spaced apart portions transferring from the carrier sheet;

providing an adherence coat for adhering the transferable replicating layer to a substrate;

pressing the carrier sheet and the replicating layer against a substrate and applying heat to adhere the replicating layer to the substrate; and releasing the carrier sheet and said adherently attached spaced apart portions from the surface of the replicating layer to provide the replicating layer as a surface finish attached to the substrate and having a plurality of discrete spaced apart portions having a lower specular reflectance than the remaining portion of the surface finish.

7. The method according to claim 6 including coating said spaced apart portions so they have a dry thickness in the range of about 5 to about 20 microns.

8. The method according to claim 7 including forming said spaced apart portions from a thermosetting synthetic resinous material.

9. The method according to claim 8 including providing a simulated wood grain finish by coating at least two printed pigmented layers over the replicating layer when said replicating layer is in contact with the carrier sheet, the replicating layer being a clear coat so that the pigmented layers are visible through it.

10. The method according to claim 6 including forming said spaced apart portions from a thermosetting synthetic resinous material.

11. A method for making a hot transfer sheet comprising a carrier sheet and transferable material on one side of the carrier sheet, in which said transferable material is releasable from the carrier sheet and said transferable material is adherently attachable to a substrate in response to heat and pressure, the method comprising the steps of:

providing a heat-resistant, flexible, foldable carrier sheet having a surface having a predetermined specular reflectance;

coating onto said carrier sheet surface a plurality of discrete spaced apart portions of a synthetic resinous material, said spaced apart portions being coated onto the carrier in a fluid condition and shrunk during drying to form irregularly-shaped surfaces remote from the surface of the carrier sheet and having a lower specular reflectance than that of the uncoated portion of the carrier sheet surface, said spaced apart portions being so adherently attached to the carrier sheet that they will not transfer from the carrier when heat and pressure are applied thereto;

coating over the surface of the carrier sheet and said spaced apart portions a transferable replicating layer comprising a coating of sufficient thickness of a synthetic resinous material to replicate both the specular reflectance of the uncoated portion of the carrier sheet surface and the specular reflectance of the remote surfaces of said spaced apart portions without said spaced apart portions transferring from the carrier sheet; and providing an adherence coat for adhering the transferable replicating layer to a substrate;

the carrier sheet and replicating layer being adherently attachable to a substrate, with the carrier sheet and said spaced apart portions being releasable from the surface of the replicating layer in response to the application of heat and pressure, without the spaced apart portions transferring from the carrier sheet, so that the surface of the replicating layer provides a surface finish having a plurality of discrete spaced apart portions having a lower specular reflectance than the remaining portion of the surface finish.

12. The method according to claim 11 including forming said spaced apart portions from a thermosetting synthetic resinous material.

13. The method according to claim 11 including providing a simulated wood grain finish by coating at least two printed pigmented layers over the replicating layer when said replicating layer is in contact with the carrier sheet, the replicating layer being a clear coat so that the pigmented layers are visible through it.

14. The method according to claim 11 including forming the spaced apart portions from a synthetic resinous material having a fine particulate filler.

15. The method according to claim 14 including coating said spaced apart portions so they have a dry thickness of between about 5 to about 20 microns.

16. The method according to claim 14 including forming said spaced apart portions from a thermosetting synthetic resinous material.

* * * * *

UNITED STATES PATENT AND TRADEMARK OFFICE

CERTIFICATE OF CORRECTION

PATENT NO. : 4,007,067

DATED : February 8, 1977

INVENTOR(S) : Richard E. Dunning

It is certified that error appears in the above-identified patent and that said Letters Patent are hereby corrected as shown below:

Col. 7, table "Coat D", Example 4 should be ABOVE ".5"

Col.7/8,table "Coat E", under Example 9, opposite "benzene", "35" should be -- 85 --

Col.7/8 under Example 13, opposite "coating weights, wet pounds/ream" , "4" should be -- 45 --

Col.7/8,table "Coat H", under Example 8, opposite "acetone", "37" should be -- 87 --

Col. 9, line 45, "by" should be -- my --

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*